US010974954B2

(12) United States Patent
Scheugenpflug

(10) Patent No.: US 10,974,954 B2
(45) Date of Patent: Apr. 13, 2021

(54) EMPTYING DEVICE FOR VISCOUS MATERIALS AND METHOD FOR SAME

(71) Applicant: Scheugenpflug AG, Neustadt/Donau (DE)

(72) Inventor: Erich Scheugenpflug, Neustadt/Donau (DE)

(73) Assignee: Scheugenpflug AG, Neustadt/Donau (DE)

( * ) Notice: Subject to any disclaimer, the term of this patent is extended or adjusted under 35 U.S.C. 154(b) by 13 days.

(21) Appl. No.: 16/489,089

(22) PCT Filed: Apr. 18, 2018

(86) PCT No.: PCT/EP2018/059844
§ 371 (c)(1),
(2) Date: Dec. 16, 2019

(87) PCT Pub. No.: WO2018/192943
PCT Pub. Date: Oct. 25, 2018

(65) Prior Publication Data

US 2020/0189905 A1 Jun. 18, 2020

(30) Foreign Application Priority Data

Apr. 18, 2017 (DE) ..... 10 2017 108 187.9

(51) Int. Cl.
*B67D 7/64* (2010.01)

(52) U.S. Cl.
CPC ..... *B67D 7/645* (2013.01)

(58) Field of Classification Search
CPC . B67D 7/64; B67D 7/645; B67D 7/70; B67D 7/80; B67D 7/82; B67D 2007/0444
(Continued)

(56) References Cited

U.S. PATENT DOCUMENTS 2,221,763 A * 11/1940 Ginter ..... G01F 11/021 222/261
2,443,981 A * 6/1948 Funk ..... F16N 37/02 222/259

(Continued)

FOREIGN PATENT DOCUMENTS

DE 1808241 7/1969

*Primary Examiner* — Paul R Durand
*Assistant Examiner* — Andrew P Bainbridge
(74) *Attorney, Agent, or Firm* — Head, Johnson, Kachigian & Wilkinson, PC

(57) ABSTRACT

In order to prevent the material (52) from being pressed through the press plate seal between press plate (2) and surrounding barrel (50) by means of a press plate (2) when emptying a barrel (50) in which viscous material (52) is supplied, a two-stage construction is used in accordance with the invention:

Figure 1A:
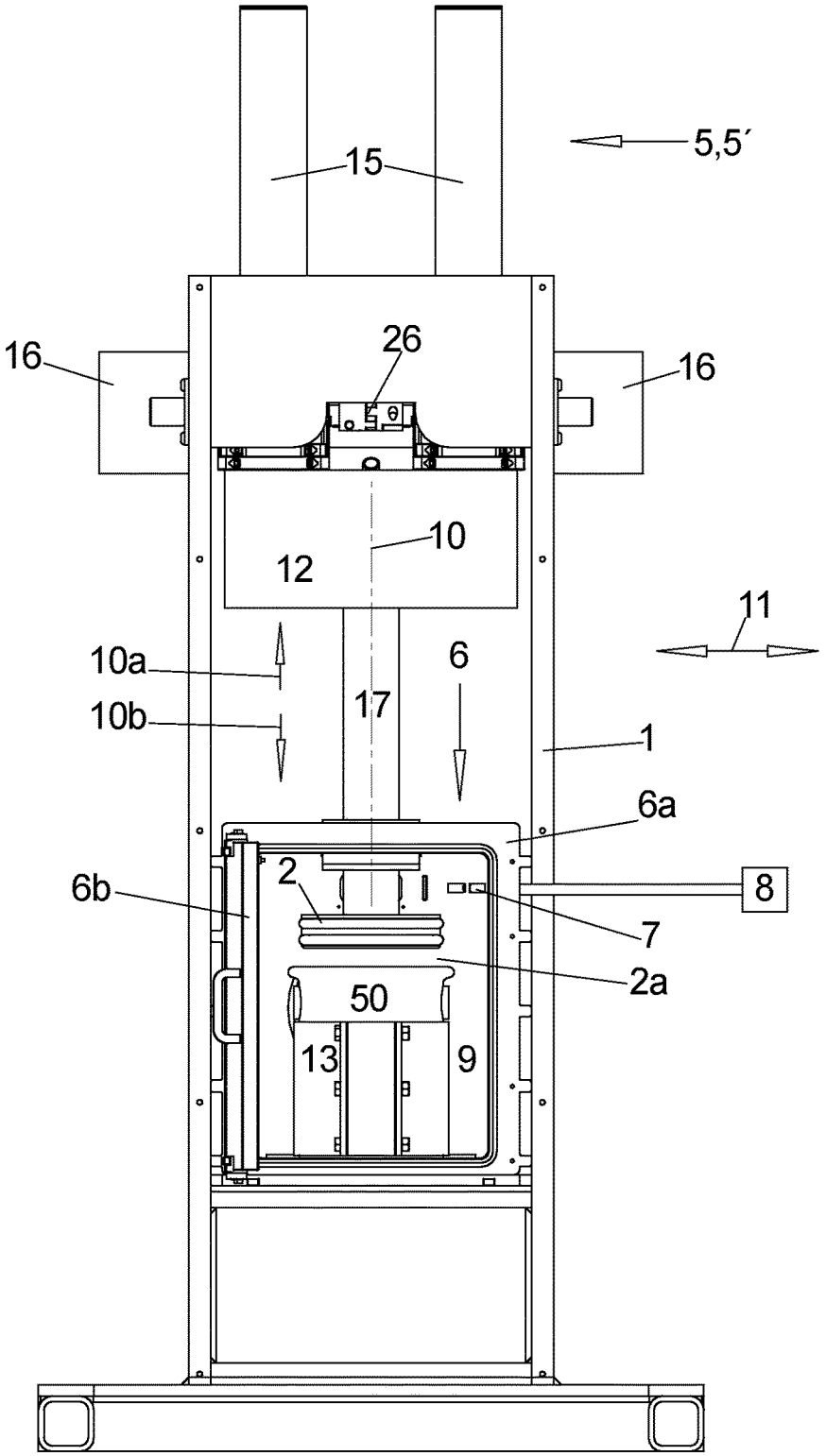
PRIOR ART Fig. 1a

A press cylinder (22) is connected to the rear side of the press plate (2), in which in turn a conveying piston (24) is guided in a sealing manner, which in turn has a smaller end face than the press plate (2). In addition, non-return valves (19) are arranged in the press plate (2) in the region radially inside the press cylinder (22), which allow the material (52) to flow only in the direction of the conveying piston (24), but not vice versa, when the press plate (2) is pressed in the direction to the bottom (50*a*) of the barrel (50).

After the press plate (2) has come to a standstill, the conveying piston (24) can thus be guided in the direction of the bottom of the press cylinder (22), i.e. in the direction of the press plate (2), and the material (52) can thereby be pressed through the conveying piston (24) into the conveyer line (4) with a pressure, which can also be significantly higher than the maximum pressure with which the press plate seal between the press plate (2) and the inner circumference of the barrel (50) may be pressurised, which, how- (Continued)

ever, does not pose a problem for the much more accurate press cylinder seal between the conveying piston (24) and the press cylinder (22).

14 Claims, 10 Drawing Sheets

(58) Field of Classification Search
USPC ..... 222/404–405, 409, 333
See application file for complete search history.

(56) References Cited

U.S. PATENT DOCUMENTS 2,630,248 A * 3/1953 Hinz ..... F16N 37/00 222/258
3,478,930 A * 11/1969 Rigby ..... B65B 63/08 222/146.1
3,758,003 A * 9/1973 Kautz ..... B29B 13/022 222/146.1
3,976,229 A * 8/1976 Jackson ..... B29B 13/022 222/146.5
4,570,833 A * 2/1986 Vanderjagt ..... F04B 53/106 222/333
5,125,785 A * 6/1992 Langen ..... B65B 69/005 414/416.01
5,285,932 A * 2/1994 Boudreau ..... B67D 7/70 222/137
5,366,351 A * 11/1994 Nolte ..... F04B 49/10 417/271
5,785,098 A * 7/1998 Sern ..... B65B 3/12 141/18
7,600,658 B2 * 10/2009 Stanton ..... B29B 7/748 222/259
7,762,428 B2 * 7/2010 Scheugenpflug ..... B05C 11/10 222/53
9,695,034 B2 * 7/2017 Sauer ..... B05C 11/1028
10,605,405 B2 * 3/2020 Lee ..... F16N 35/00
2014/0124090 A1 5/2014 Schneider
2018/0112822 A1 * 4/2018 Lee ..... F16N 35/00
2019/0314858 A1 * 10/2019 Tasaka ..... B05C 1/02
2020/0189905 A1 * 6/2020 Scheugenpflug ..... B67D 7/645

* cited by examiner

EMPTYING DEVICE FOR VISCOUS MATERIALS AND METHOD FOR SAME

I. FIELD OF APPLICATION

The invention concerns the emptying of highly viscous, i.e. pasty, substances from delivered containers, in particular barrels.

II. TECHNICAL BACKGROUND

When processing highly viscous materials, e.g. in adhesive technology or the cosmetics industry, there is often the problem that these materials or their basic materials are delivered in transport containers such as 200 l barrels or 20 l buckets and the viscous material has to be delivered from there to a consumer, for example a dosing gun or a mixer.

In the following, only barrels are mentioned, but for the purposes of the present invention this should include all containers which are open on one side, since, for example, in the case of a cartridge, the face of the cartridge, which is in principle open, is generally closed by a stopper which is movable in the axial direction and closes tightly, and, in addition, the cartridge usually has a emptying opening on the opposite face.

The removal from the container and the transport to the distant consumer should take place automatically as required, and it should be possible to empty the barrel as completely as possible without time-consuming manual reworking.

Due to the characteristics of the viscous material, it is often not permissible to heat it prior to removal and transport via pipes in order to increase its flowability.

In this context, so-called barrel presses are already known, in which a press plate is placed on the viscous material in the barrel to be emptied, which has, for example, a through opening in the middle to which a conveyer line for the viscous material is connected.

The outer circumference of this press plate is tightly fitted to the inner circumference of the barrel. By pressing the pressing plate downwards with sufficient force and corresponding to the path, the viscous material is pressed into the conveyer line and in this way delivered to the consumer remote from the barrel in the desired quantity and with sufficient pressure at the consumer, whereby depending on the length of the conveyer line in the course of which one or more pumps can be additionally arranged.

This type of barrel emptying has several problems:

On the one hand, the force required to press the press plate down increases sharply with increasing viscosity, i.e. toughness, of the material to be conveyed, so that it is hardly possible to convey relatively tough, highly viscous material over longer conveying distances without an additional pump in the emptying device or along the conveying distance.

Another problem is that when the press plate is placed on the viscous material, air is trapped under the press plate, which enters the conveyer line when the material is conveyed. This is basically undesirable, as the material is often to be dispensed in precisely metered quantities by the consumer, and this metering is no longer possible with air bubbles in the conveying line, and as a result, for example, an adhesive application produced can become incomplete and thus faulty.

Furthermore, in order to reduce the necessary pressing force, especially with highly viscous materials, it would be advisable to advantage the flow of the material into the conveyer line by a conical design of the pressing plate. This, however, leads to a high residual quantity which remains in the barrel towards the end of the emptying process.

Furthermore, it must be avoided that the relatively high forces on the press plate damage the press plate or the drive of the press plate if the press plate reaches the bottom of the barrel and the drive is not stopped in time.

Another problem is that with increasing viscosity of the material, the pressure drop increases massively over the conveying length and the pressure in the material to be conveyed in or near the barrel press cannot be used to deduce the pressure in the material at the consumer.

If, on the other hand, such a container is emptied conventionally, i.e. by means of a pump, for example a piston pump, the problem is that many different materials contain very abrasive fillers which cause each pump to wear out within a short time.

Another problem in this context is that the rear side pressure in the conveyer line can become so high that the seal between the outer edge of the pressing plate and the inner circumferential wall of the barrel is penetrated by the material and material reaches the top of the pressing plate.

III. PRESENTATION OF THE INVENTION a) Technical Object

It is therefore the object, according to the invention, to create an emptying device with a barrel press that functions reliably even with highly viscous materials and has a sufficient duration of life, as well as to provide a method for emptying such highly viscous materials.

b) Solution of the Object

With regard to the emptying device, this object is solved by the fact that the conveyer line is not attached directly to the through opening of the press plate.

Instead, from the rear side, usually the top side, of the press plate extends out a press cylinder in the withdrawal direction, which is tightly connected with its front, usually lower, end to the press plate, which thus partly forms its bottom.

Since this press cylinder together with the press plate enters the container when the container is emptied, the press cylinder has a free inner diameter which is smaller than the free inner diameter of the container to be emptied, and the outer circumference of the press cylinder is also positioned at a radial distance from the outer edge of the press plate, i.e. radially offset inwards.

In the press cylinder, a conveying piston is axially displaceable close to the inner circumference of the press cylinder, as is the press plate itself, both in the conveying direction and in the withdrawal direction, and driven by its own conveyor drive, which can be controlled independently of the press drive, which moves the press plate axially.

In the conveying piston there is a through opening, usually centric, on the rear side of which the conveyer line is tightly fixed through which the material to be conveyed can flow.

So that the material from the barrel can reach this opening in the conveying piston, one or more non-return valves are provided in the press plate so that the material can only penetrate the press plate from the front to the rear, i.e, usually from bottom to top, i.e. in the direction of the conveying piston, but not vice versa.

The non-return valves should preferably not protrude beyond the rear side of the press plate and/or its front side.

The following procedure is possible by means of this arrangement: First the press plate and the conveying piston are brought into their initial position. For the press plate, this means that it is moved into the container through the open end face of the container and placed on the surface of the material to be removed.

For the conveying piston, this means that it is brought into an axial starting position which is usually as close as possible to the rear side of the press plate by preferably resting on this rear side of the press plate.

Then the following process—depending on the material requirement more or less fast, but as a rule often successively—is carried out until finally no more material is needed or the container is empty:

a)

The press plate together with the press cylinder attached to it is moved further in the press direction into the container, i.e. in the direction toward the bottom of the container. The material under pressure in the container flows through one or more non-return valves through the press plate to its rear side and begins to fill the press cylinder, pushing the conveying piston in the press cylinder rear side from its initial position in the retraction direction:

Since the free inner diameter of the container is larger than the free inner diameter of the press cylinder, pushing the press plate forward by one length unit in the conveying direction means that the conveying piston—in order to absorb the displaced material volume—is pushed rear side by more than this length unit from its initial position relative to the press cylinder in the withdrawal direction.

When a preset filling level is reached in the press cylinder in this way, i.e. the conveying piston has reached a preset axial nominal position, the following is achieved b)

the axial movement of the press plate is stopped.

c)

With the press plate still stopped, i.e. stationary, the conveying piston is now moved in the press direction, i.e. towards the press plate, until it has reached a specified target position, usually adjacent or directly adjacent to the press plate. Since the material trapped between the conveying piston and the rear side of the press plate cannot escape through the non-return valves, the material is pressed into the through opening in the conveying piston and the conveyer line connected to it—which subsequently to the conveying piston usually first consists of the hollow piston rod of the conveying piston—and is thus transported in the direction toward the consumer.

This has the advantage that when pressing the material out of the press cylinder into the delivery line, higher pressures can also be applied than the maximum permissible value for the press plate gasket.

However, the seal between the outer circumference of the conveying piston, which can be precisely matched to each other, and the inner circumference of the press cylinder—which can also be manufactured more stable than a barrel—is generally much more resilient than the gasket between the press plate and the inner circumference of the barrel, which is subject to great manufacturing inaccuracies.

In this way, even with very viscous material, reliable conveying of the material is possible without material being forced through the seals.

The starting position, desired position and target position of the conveying piston can, of course, preferably be adjustable, as can the distance that the press plate fullfills during each conveying operation.

In addition, for the control of the process, the pressure in the material is measured, for example on the front side of the press plate and/or on the front side of the conveying piston and/or in the conveyer line, close to the conveying piston and/or close to the consumer.

On the basis of these pressure values and the known parameters of the material to be emptied, the movement of the press plate and/or conveying piston is controlled with regard to the chronological sequence, duration and speed of these components.

In order to avoid air inclusions in the material to be conveyed, the space between press plate and the upper side of the material in the container is subjected to negative pressure either before or during the placing of the press plate on the upper side of the material in the container, or the entire container to be emptied is at least tightly positioned with its open side in an surrounding, the internal space of which is subjected to negative pressure before or during the placing of the press plate on the material, in order to reliably avoid air inclusions.

For the implementation of this method, further details should be provided for the emptying device:

The internal diameter of the press cylinder is not chosen as large as possible relative to the internal diameter of the container to be emptied, in particular the barrel, but preferably at least 5%, better at least 10%, better at least 15%, better at least 20%, better at least 30% smaller, in particular to keep the circumferential length of the seal between the conveying piston and the press cylinder as small as possible.

The press plate drive and the conveyor plate drive can be controlled independently of each other and preferably contain one or two parallel threaded spindles as drive elements or a working cylinder, for example a hydraulic cylinder or a pneumatic cylinder.

Simple ball valves or other types of no-return valves can be used as no-return valves. Preferably, the no-return valves should not protrude beyond the rear side of the press plate—otherwise the conveying piston could not be moved fully up to the rear side of the press plate—and/or should not protrude beyond the front of the press plate—otherwise the front of the press plate could not be moved fully to the bottom of the barrel.

Therefore, the press plate should preferably have such a thickness in the axial direction that the one or more no-return valves in the axial direction can be fully accommodated in it.

In order to ensure rapid passage of the material through the press plate in the direction of the conveying piston, the sum of the free passages of the non-return valves present as a whole—all of which may only be located in the radial area within the free diameter of the press cylinder—should be at least 15%, better at least 20%, better at least 30%, better at least 40%, better at least 50% of the bottom area of the press cylinder in their open state.

In order to avoid any leakage problem between the press plate and the subsequent press cylinder, the safest solution is to manufacture the press plate in one piece together with the press cylinder, but this requires a high manufacturing effort and will usually only be chosen for extremely thin materials.

Preferably, however, the press plate is attached to the press cylinder in a simple manner, i.e. both detachable and mountable.

This has several advantages:

On the one hand, the press plate can be removed from the press cylinder for cleaning purposes.

Above that adapted to the diameter of the barrel to be emptied, a corresponding press plate can be attached to the press cylinder so that the emptying device can be used for barrels of different diameters.

To control the process, pressure sensors are used on the one hand, in particular at the aforementioned positions, and position sensors on the other, which are present either at the pressing plate and/or at the conveying piston, and which measure the axial position of the press plate within the emptying device, i.e. in the state of use relative to the barrel, on the one hand, and the axial position of the conveying piston relative to the press cylinder on the other hand.

In order to intensify the discharge of the material, a hose pump acting from the outside on the hose is preferably provided in the conveyer line, which consists at least in sections of a flexible hose.

In order to avoid air inclusions in the conveyed material, a vacuum connection can be provided in the front of the press plate—radially away from the area of the press cylinder—and/or in the conveyer line.

Another way to avoid air inclusions in the conveyed material is that the frame of the emptying device also comprises an enclosure in which either the whole container or at least the part of it containing the open side of the container can be placed and at least the open side can be sealed tightly. The enclosure has a vacuum connection, via which the internal space of the enclosure can be connected to a vacuum source.

In order to minimize the increase in pressure due to friction of the material on the inside of the conveyer line, the inside surface of the conveyer line may have a friction-reducing surface design.

Since in the described process there is no continuous conveying of the material through the conveying piston, there is preferably a buffer for material in the conveyer line so that the material from the buffer can continue to supply the connected consumer with material from the buffer even when the conveying piston in the press cylinder is stationary.

Such a buffer in the conveyer line can, for example, be a piston pump or a diaphragm pump with a sufficiently large volume.

As a rule, the piston rod of the conveying piston, and possibly even the press cylinder, will then have to extend through the enclosure.

c) Examples of Solutions

The following are examples of constructions according to the invention.

A a state-of-the-art barrel press with open vacuum container shows

Figure 1B:
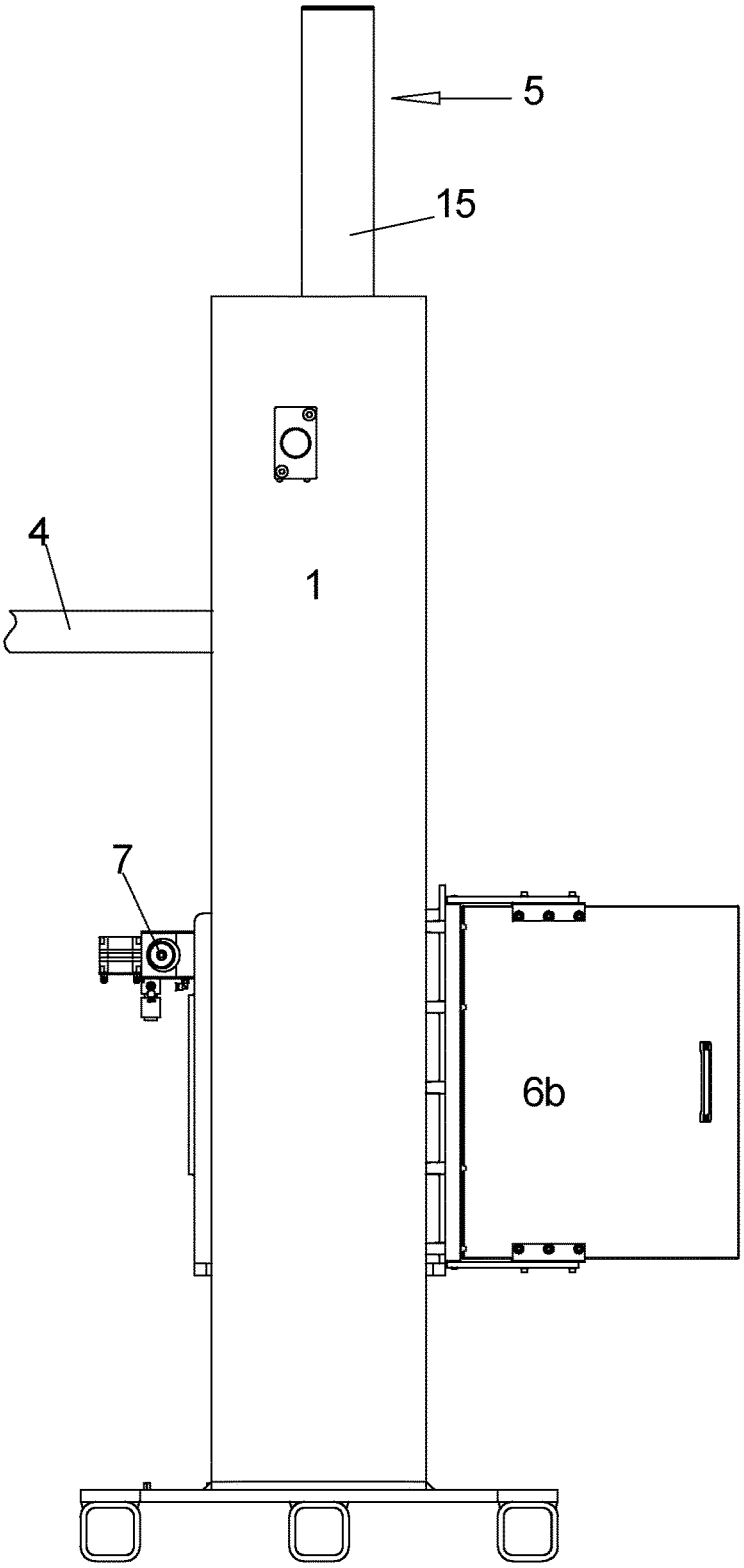
PRIOR ART Fig. 1b
Figure 1C:
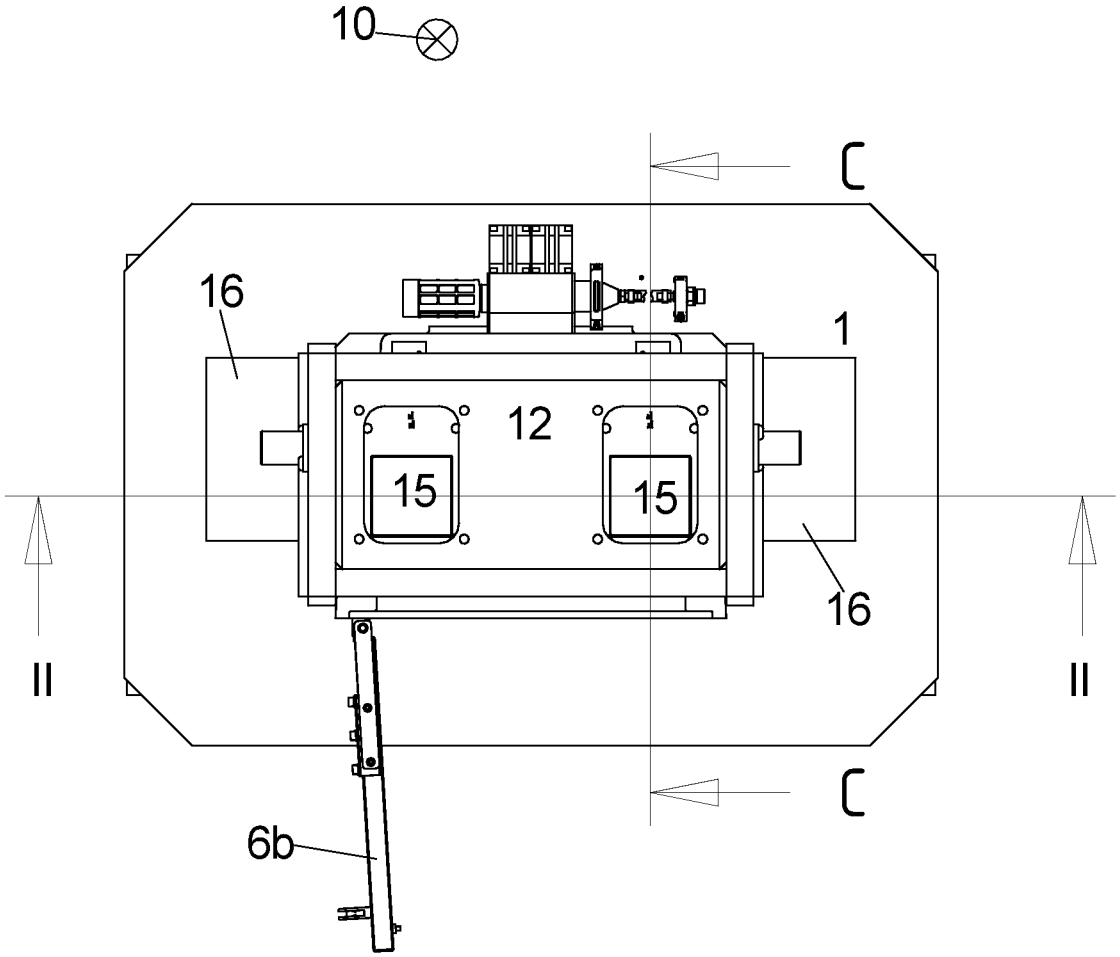
PRIOR ART Fig. 1c
Figure 2:
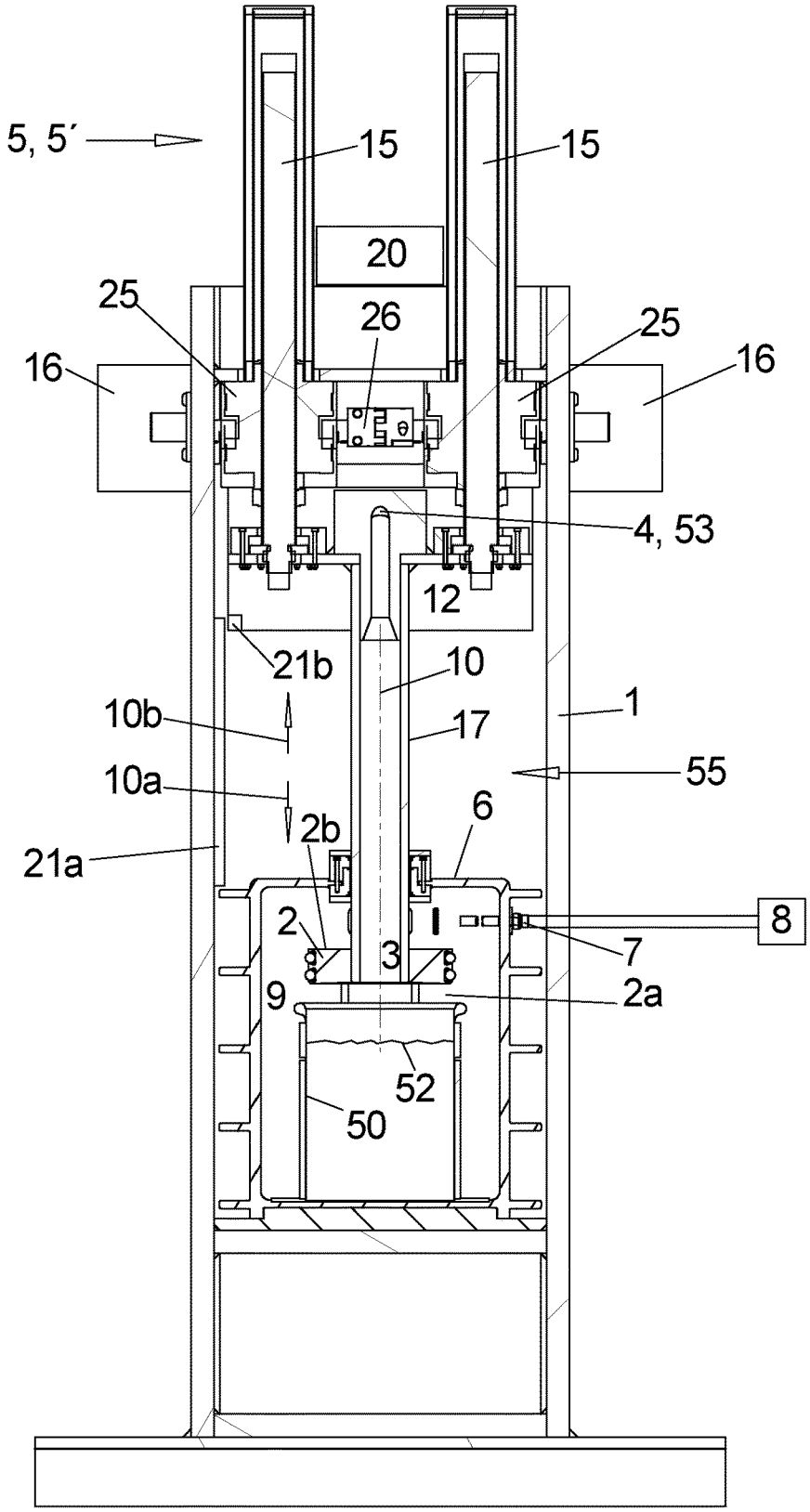
PRIOR ART Fig. 2
Figure 3:
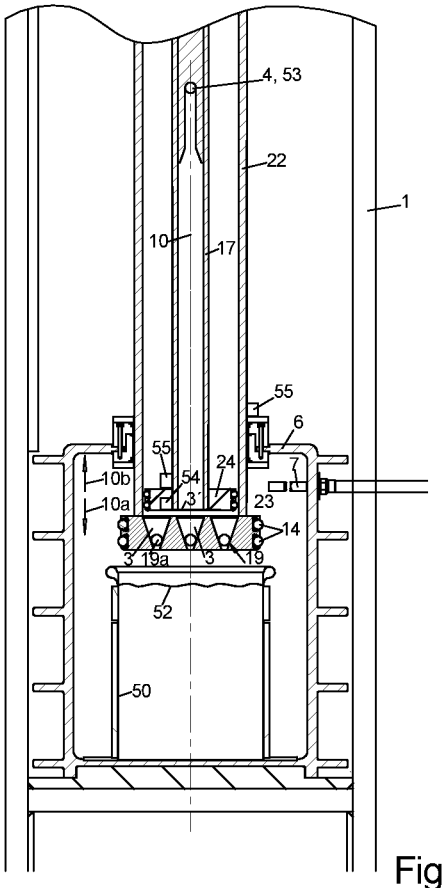

FIG. 1*a*: in the front view,

FIG. 1*b*: in the side view,

FIG. 1*c*: in the top view,

FIG. 2: in vertical section in direction of view from the front and a barrel press according to the invention shows FIG. 3: in the same vertical section as FIG. 2, FIGS. 4*a* to *e*: in different functional positions of the barrel press according to FIG. 3

FIGS. 1*a, b, c* and 2 show an emptying device in the form of a barrel press in exterior views and in sectional views:

Material 52 is to be conveyed from the barrel 50, which is open at the top and shown in FIGS. 1*a* and 2, by the pressing plate 2, which can be tightly pushed into the inner circumference of the barrel 50 from above, and exerts pressure on the material 52 with its pressure side 2*a*, so that the material 52—as can best be seen in FIG. 2—is then pressed upwards by the hollow piston rod 17 projecting from the opposite rear side 2*b* and is pushed by the conveyer line 4 connected thereto to the consumer 53 indicated only in FIG. 2.

Since this process is to take place under negative pressure, i.e. ideally under vacuum, the barrel 50 is first placed in an enclosure 6 consisting of a solid housing 6*a* and the door 6*b* shown in the opened state, which seals the enclosure 6 in the closed state, in whose internal space 9 the desired vacuum is generated. For this purpose, enclosure 6 has a vacuum connection 7 which connects enclosure 6 to a vacuum source 8.

As the only element the piston rod 17, at the front end of which the pressing plate 2 is fixed and which moves the pressing plate 2, extends through the top of the enclosure 6 into its internal space 9, the passage being appropriately sealed so that no air from outside can penetrate into the internal space 9 which is under negative pressure.

Since very high forces of up to 100 tons have to be applied to the press plate 2 or the piston rod 17 driving it in the case of highly viscous materials for this purpose, the enclosure 6 is located in a solid frame 1, in the upper area of which two vertically arranged and parallel threaded spindles 15 or also ball screw spindles are arranged side by side, which act jointly on a transverse yoke 12, which is connected to the rear, upper end of the hollow piston rod 17, which extends to the press plate 2.

In order to prevent the pressure exerted by the press plate 2 on the material 52 in the barrel 50 from deforming the barrel 50 radially or even bursting the barrel 50, a stable surrounding 13—see FIG. 1*a*—is usually fitted around the barrel 50 using state-of-the-art technology, which lies close to the outer sides of the barrel 50 and withstands the pressure prevailing therein.

However, even in this case, the pressed-plate gasket is not completely tight due to deformation of the barrel, and in addition, such a stable surrounding 13 not only requires time and effort to manufacture the device, but also, depending on the dimension of the barrel, a separate, matching surrounding 13 is required, usually also for the barrels of different manufacturers.

Even when setting a new barrel 50 in an surrounding with such a stable surrounding for the barrel, this makes the setting process of each barrel cumbersome and error-prone.

A further disadvantage is the fact that barrels have a relatively large range of variation in their actual dimensions, especially with regard to wall thickness, inner diameter and outer diameter.

In accordance with the invention, it is therefore proposed to design the emptying device according to FIG. 3 using the same view as FIG. 2:

It can be seen here that a press cylinder 22 extends upwards from the rear side 2*b* of the press plate 2, i.e. in the withdrawal direction 10*b* of the axial direction 10, and in the cross-section of the press plate 2 within the inner circumference of this press cylinder 22 there are at least one, generally several, through openings 3 for the material 52 to be conveyed, which are now, however, in each case constructed as non-return valves 19, in this case with a ball 19*a* as valve unit. The flow direction of this at least one non-return valve 19 is exclusively the direction from bottom to top, i.e. into the inside of the press cylinder 22, and not vice versa.

The press plate 2 usually rests against the inner circumference of the wall 50*b* of the barrel 50 via several press plate gaskets 14 arranged one behind the other in the axial direction 10.

The press cylinder 22 is hollow in axial direction 10 and in it a press piston 24 is tightly guided so that it can be moved in axial direction, sealed by several conveying piston seals 23, which are usually arranged one behind the other in axial direction.

The conveying piston 24 has a central through opening 3', which opens into the piston rod 17, which is hollow in the axial direction and extends upwards from the conveying piston 24, i.e. in the withdrawal direction 10*b*, and to which in its upper, downstream end region the conveyer line 4 is connected, which leads to the consumer 53.

The pressing plate 2 on the one hand and the conveying piston 24 on the other hand can be moved independently in axial direction 10 both in press direction 10*a* and in withdrawal direction 10*b*.

The positions of conveying piston 24 and press plate 2 can each be monitored by each one or a common position sensor 55, one of which is located at the enclosure 6 next to the opening for the piston rod 17 as shown in FIG. 3 and the other at the piston rod 17. There may also be a pressure sensor 54, for example in the underside of the conveying piston 24, to measure the pressure in the material 52 below.

The movement takes place either by means of a common drive 5, but nevertheless independently of each other in so far as with this common drive 5 either the press cylinder 22, i.e. the piston rod of the pressing plate 2, or the piston rod 17 of the conveying piston 24 or both can be coupled simultaneously.

The press cylinder 22 is slidably and can be moved in the passage in the upper side of the housing 6 sealed in axial direction, as it was also the case with the state of the art solution for the piston rod 17 of the press plate 2.

Of course, it is also possible to drive the press plate 2 on the one hand and the conveying piston 24 on the other hand in axial direction by means of separate drives, i.e. to couple one drive each with the press cylinder 22 on the one hand and with the piston rod 17 on the other hand.

With this construction of the emptying device it is possible to insert the press plate 2 into the open upper side of the barrel 50, to place it on the material 52 to be removed and by further moving the press plate 2 downwards to let the material 52 flow through the through openings 3 of the press plate 2—the passage direction 19' of the non-return valves 19—in the area above the press plate 2 and thus into the press cylinder 22. The prerequisite for this is that the conveying piston 24 does not resist the material 52 when it reaches it, but only the sliding friction between the conveying piston seal 23 and the press cylinder 22 must be overcome, as well as the dead weight of the conveying piston 24 and its piston rod 17.

When press plate 2 and conveying piston 24 are driven together, the press plate 2 must not be pressed down by the common drive 5 and the conveying piston 24 must not be coupled to this drive but must be freely movable relative to this drive.

In order to press the material through the piston rod 17 and the connected conveyer line 4 to the consumer, a considerably higher pressure is required. This is applied by, after sufficient filling of the internal space of the press cylinder 22 with material 52, stopping the forward movement, i.e. downward movement, of press plate 2 and pressing the conveying piston 24 downwards with press plate 2 stationary. With a common drive 5, this means that press plate 2 must be uncoupled from drive 5 and the conveying piston 24 must be connected directly to drive 5 instead.

However, the necessary high pressure now only occurs between the upwardly facing rear side of the press plate 2 including the non-return valves 19—which are not permeable to the material 52 from top to bottom—and the conveying piston 24 and thus also in the piston rod 17, but not in the area between the bottom 50*a* of the barrel 50 and the press plate 2. Thus this high pressure also does not affect the press plate gasket 14 between the press plate 2 and the barrel 50, the sealing effect of which can thus be considerably lower than that of the conveying piston seal 23.

In addition, the pressure between press plate 2 and conveying piston 24—when the same force is applied as with the known solution according to FIGS. 1 and 2—is significantly higher due to the smaller cross-sectional area of the conveying piston 24 compared to the cross-sectional area of the press plate 2 as it is relevant with the known solution. This means that a weaker drive 5 is sufficient to generate the same pressure in the solution according to the invention.

In this way a barrel can now be emptied in one or more steps, as can be seen from FIG. 4*a-e:*

Figure 4A:
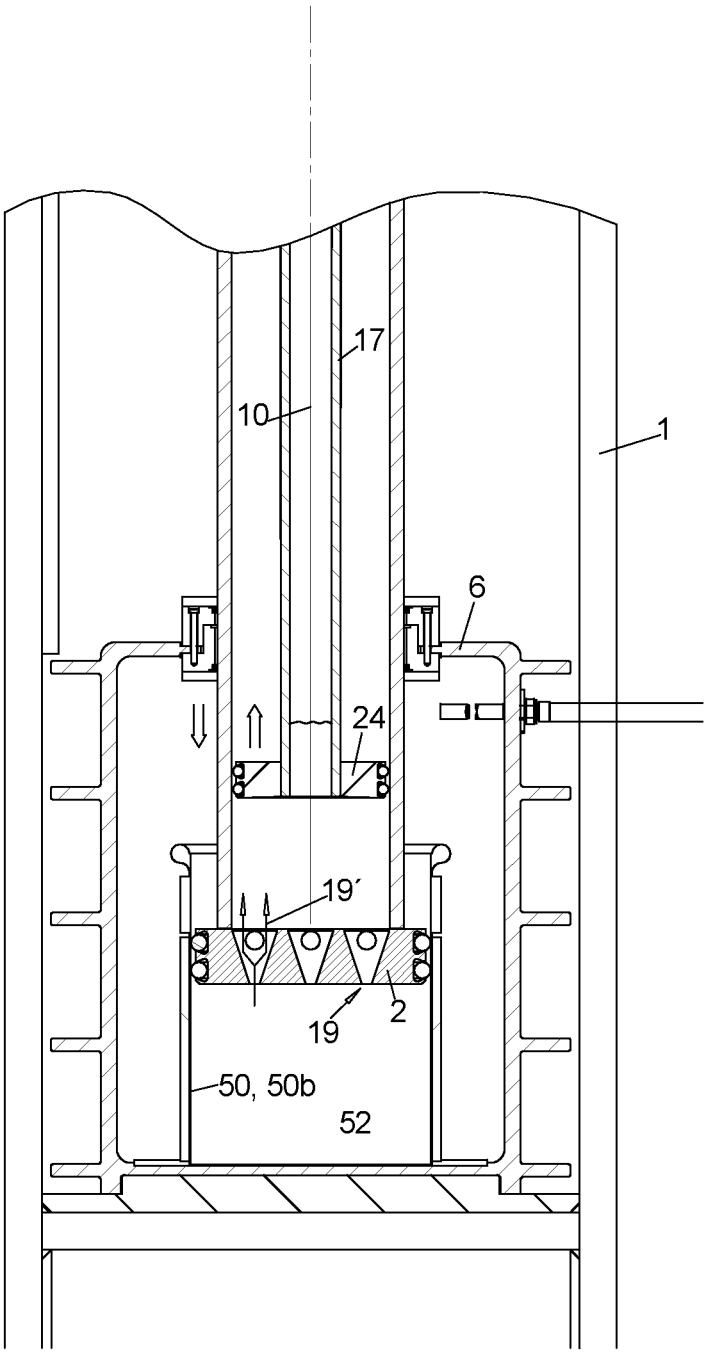

In the first step according to FIG. 4*a*, the press plate 2 is inserted into the barrel 50, placed on the surface of the material 52 contained therein, and moved downwards until a sufficient amount of material in the press cylinder 22 is below the conveying piston 24, which has thereby either been pushed up or has already been in a pushed up position relative to the press plate 2.

Figure 4B:
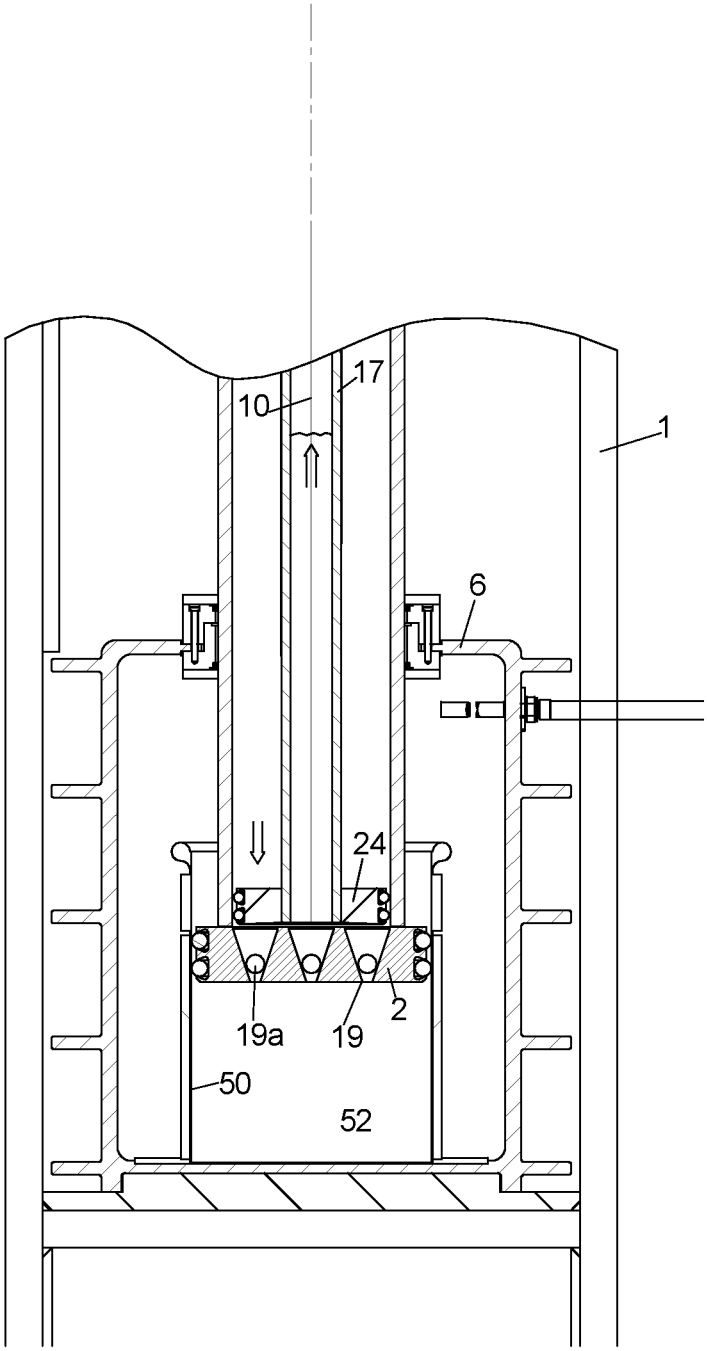

Afterwards the press plate 2 is stopped according to FIG. 4*b* and by moving the conveying piston 24 down, i.e. moving it in forward direction, the material between the stationary press plate 2 and the conveying piston 24 is pressed as far as possible into the piston rod 17 and thus finally into the conveyer line 4 and to the consumer 53. The forward movement of the conveying piston 24 ends at the latest when contacting the rear side 2*b*, i.e. the upper side, of the press plate 2.

Figure 4C:
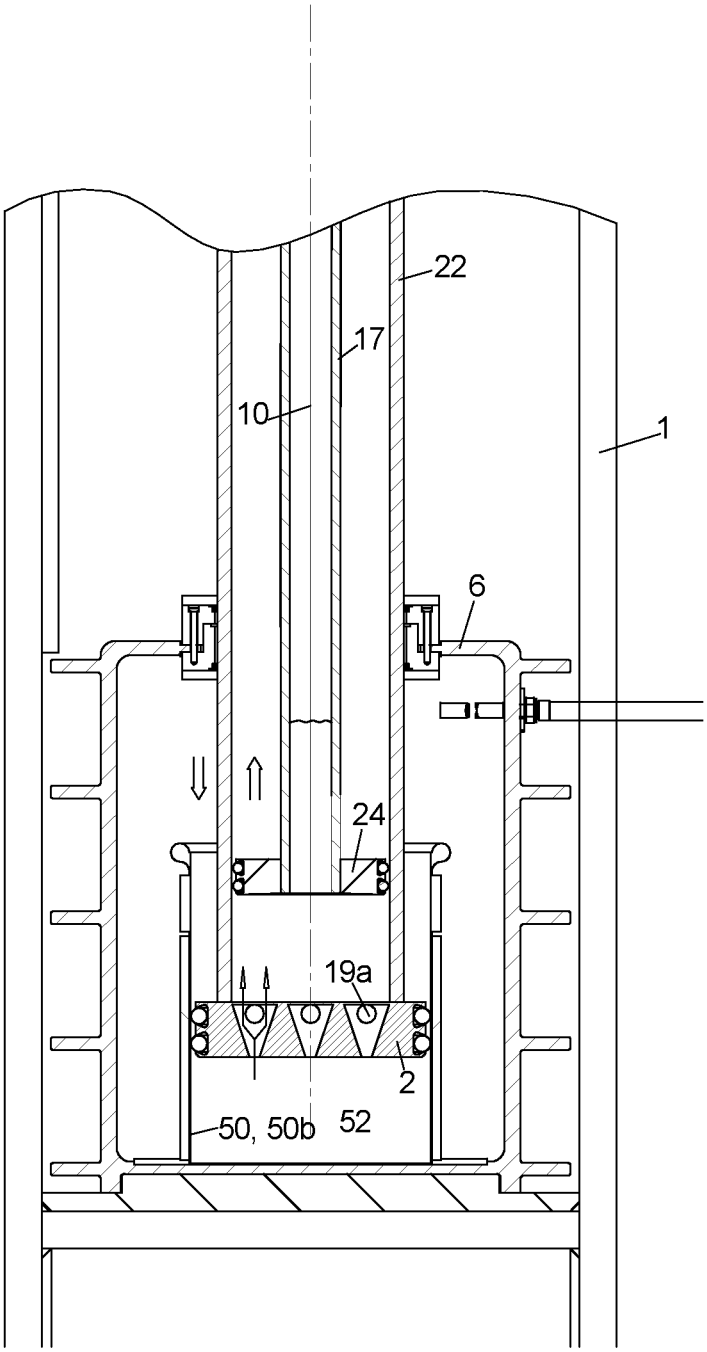
Figure 4D:
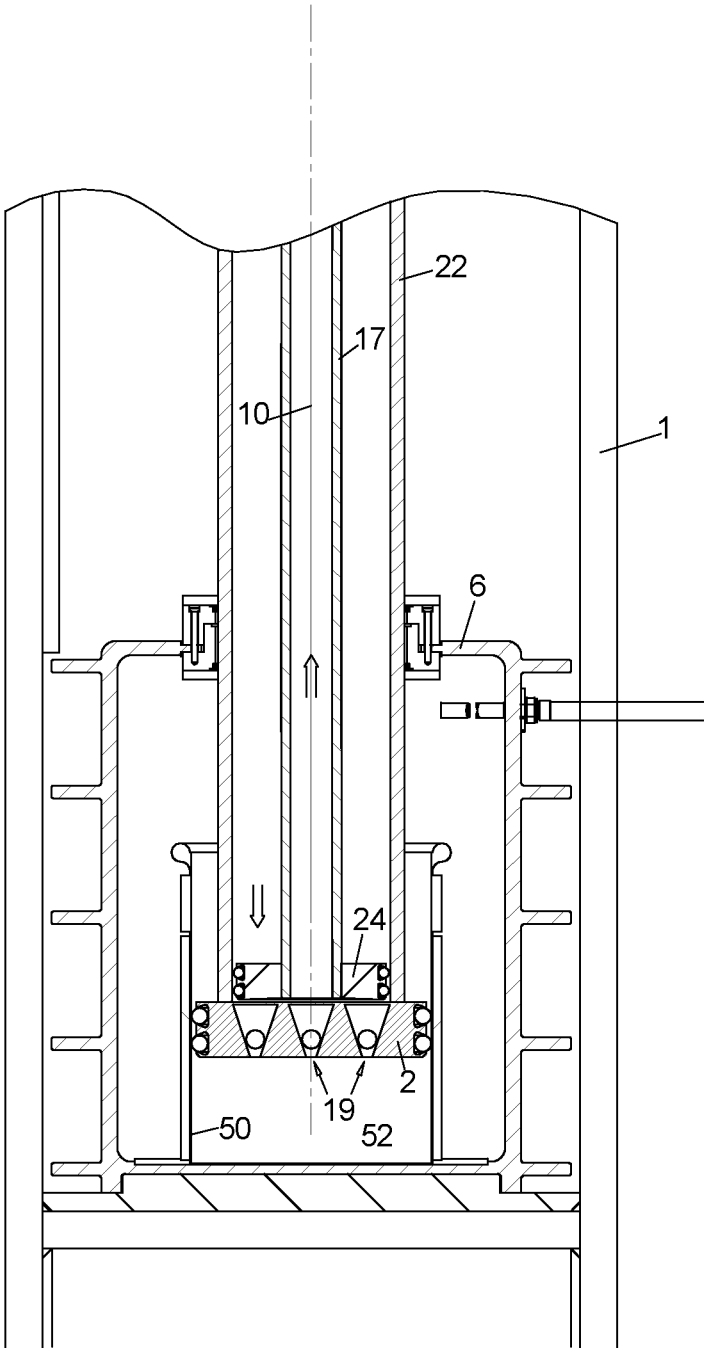
Figure 4E:
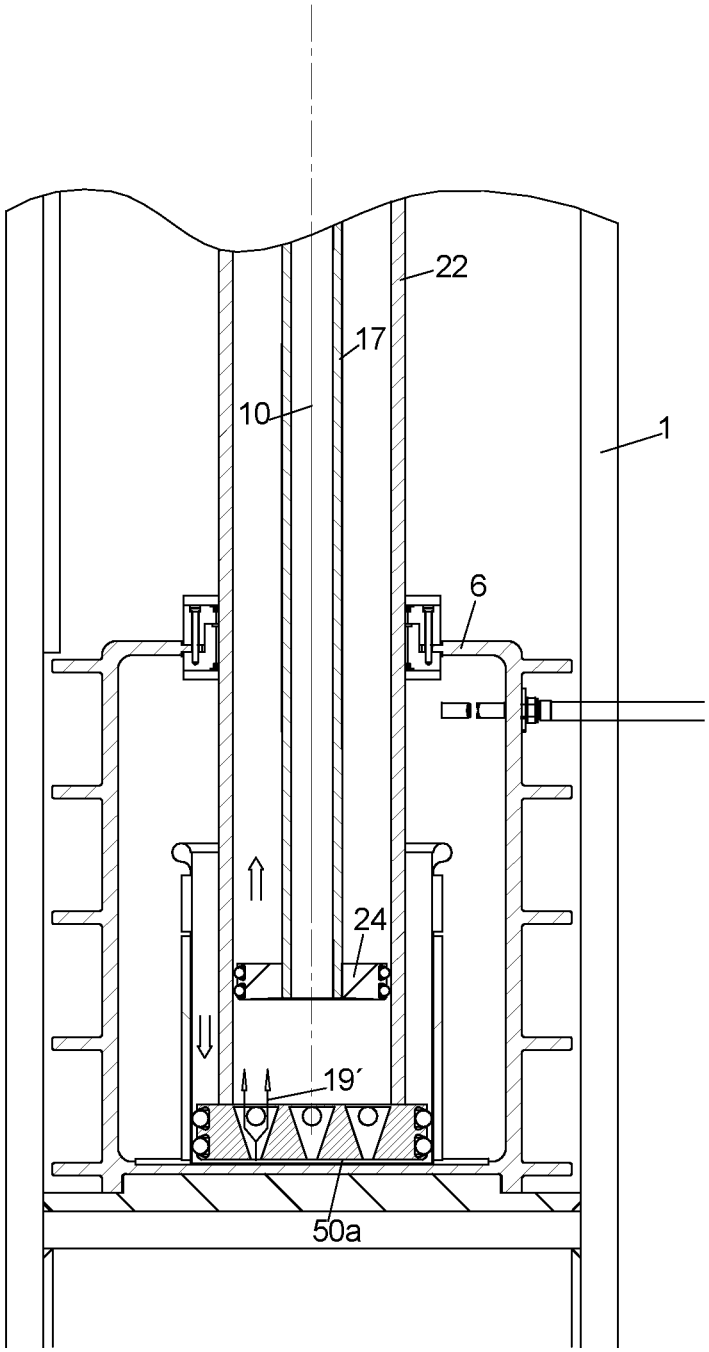

This procedure can be repeated once or several times according to FIGS. 4*c* and *d*.

In a final emptying step, press plate 2 is then lowered until it sits on the bottom 50*a* of barrel 50, then stopped and the conveying piston 24 is lowered until it sits on the rear side 2*b*, the top, of press plate 2.

This empties the barrel, the press plate 2 can be moved upwards out of the barrel 50 and the empty barrel 50 can be changed for a full one.

In the state of the art as well as in the inventive solution, a spindle nut 25 can be fixed in the frame 1, through which the threaded spindle 15 extends. Each of the two threaded spindles 25 is driven by a separate electric motor 16, whereby the rotations of the two spindle nuts 25, which cause the axial movement of the threaded spindles 15, are mechanically synchronized by a synchronous connection acting between the two spindle nuts 25 and connected to both of them, in particular in the form of a coupling.

In order to know the respective position of the press plate 2 in the feed direction, a position sensor 21 is arranged on the frame, consisting for example of a sensor strip 21*a*, which is fastened to the inside of the frame 1, and a position transmitter, for example a position magnet 21*b* in the case of a magnetostrictive sensor, which is arranged in a vertical position, the sensor strip 21*a* is moved in the axial direction when the unit consisting of threaded spindles 15, yoke 12, piston rod 17 and press plate 2 is moved downwards along the sensor strip 21*a* and thus detects the position of the press plate 2, so that press plate 2 can be stopped when it has reached the bottom of barrel 50 and the barrel is emptied.

The conveyer line 4 which discharges the material is attached to a corresponding connection stub of the yoke 12, so that the conveyer line 4 usually consists of a flexible but high-strength hose which is led away from the rear of frame 1 as shown in FIGS. 1*b* and 2.

REFERENCE SIGN LIST

1 frame
2 press plate
2*a* front side
2*b* rear side
3, 3' through opening
4 conveyer line
5 drive
6 enclosure
6*a* housing
6*b* door
7 vacuum connection
8 vacuum source
9 internal space
10 axial Direction, Vertical
10*a* press direction
10*b* withdrawal direction
11 transverse direction, horizontal
12 yoke
13 surrounding
14 press plate gasket
15 threaded spindle
16 electric motor
17 piston rod
18 spring package, energy accumulator
19 non-return valve
19' passage direction
19*a* ball
20 control
21*a, b* position sensor
22 press cylinder
23 conveying piston seal
24 conveying piston
25 spindle nut
26 clutch
50 barrel
50*a* bottom
50*b* peripheral wall
52 material
53 consumer
54 pressure sensor
55 position sensor

The invention claimed is:

1. An emptying device for supplying a consumer (53) with viscous material (52) from a barrel (50) having an open side (50*a*) and a peripheral wall (50*b*) running in the axial direction (10), the emptying device comprising:

a frame (1) for receiving the barrel (50), a movable press plate (2), which is selectively driven both in the press direction (10*a*) and in the withdrawal direction (10*b*) by a press plate drive (5), fits into the barrel (50) from the open side and, thereby same time, bears closely with its outer edge against the inner surface of the peripheral wall (50*b*) of the barrel (50), a conveyer line (4), connected to a through opening (3) of the press plate (2), for the material (52) to be conveyed away, characterised in that a press cylinder (22) extends from the rear side of the press plate (2) in the retraction direction (10*b*), at least one non-return valve (19) with a passage direction (19') from the front side (2*a*) to the rear side (2*b*) of the press plate (2) is located in the radial region within the press cylinder in the press plate (2), a conveying piston (24) which can be moved both in the press direction (10*a*) and in the withdrawal direction (10*b*) by a conveying drive (5') is present in the press cylinder, the outer edge of the conveying piston (24) lies closely against the inner surface of the peripheral wall (50*b*) of the press cylinder (22), the conveying piston (24) has a through opening (3') to the rear of which the conveyer line (4) is connected.

2. The emptying device according to claim 1, characterised in that the inner diameter of the press cylinder (22) is smaller than the free inner diameter of the peripheral wall (50*b*) of the container (50) and the inner diameter of the press cylinder (22) is at least 5% smaller than the free inner diameter of the peripheral wall (50*b*) of the barrel (50).

3. The emptying device according to claim 1, characterised in that the press plate drive (5) or the conveyor drive (5'), which may also be functionally combined to a single drive, comprise one or two threaded spindles running in parallel or a working cylinder.

4. The emptying device according to claim 1, characterised in that the at least one non-return valve (19) is a ball valve or the sum of the free passages of the non-return valves (19) present in their open state is at least 15% of the bottom area of the compression cylinder (22).

5. The emptying device according to claim 1, characterised in that the press plate (2) is made in one piece with the press cylinder (22)

or the press plate (2) is fastened to the press cylinder (22) in a dismountable and mountable manner.

6. The emptying device according to claim 1, characterised in that at least one pressure sensor (54) is present at the conveying piston (24) or close to the consumer, which pressure sensor measures pressure in the material (52), or at least one position sensor (55) is present at the press plate (2) or at the conveying piston (24), which sensor either measures the axial position of the press plate (2) in the emptying device or measures the axial position of the conveying piston (24) in the press cylinder (22).

7. The emptying device according to claim 1, characterised in that the conveyer line (4) has at least sections of a flexible hose and a hose pump acting on the hose from the outside is arranged at the flexible hose, or a vacuum connection (7) is present in the front side (2*a*) of the press plate (2) radially away from the press cylinder (22) or in the conveyer line (4) at or near the consumer, or the inner surface of the conveyer line (4) has a friction-reducing surface.

8. The emptying device according to claim 1, characterised in that a buffer for material (52) is present in the conveyer line (4), in the form of a piston pump or a diaphragm pump, having a sufficiently large volume in order to be able to continue to supply the consumer with material (52) from the buffer in case of a standstill of the emptying of the container (50).

9. The emptying device according to claim 1, characterised in that the frame (1) comprises an enclosure (6) which can be tightly closed or opened for introducing at least the part of the container with the open side or for introducing the entire container (50), the enclosure (6) has a vacuum connection (7) via which the internal space (9) of the enclosure (6) can be connected to a vacuum source (8), the piston rod (17) of the conveying piston (24) and the press cylinder (22) extend through the wall of the enclosure (6).

10. A method for emptying viscous material (52) from a barrel (50) which is open on one side by means of an emptying device according to claim 1, wherein the press plate (2) is placed on the surface of the material (52) in the barrel (50), wherein the conveying piston has an axial starting position relative to the press plate (2) and selectively contacts the rear side (2*b*) of the press plate (2), and then a) the pressing plate (2) is further moved into the barrel (50) in the conveying direction (10*a*) until the material (52) passing through the at least one non-return valve has filled the press cylinder to a predetermined filling level and pushed the conveying piston in the press cylinder rear side in the withdrawal direction (10*b*), b) the press plate (2) is stopped, and c) with the press plate (2) stationary, the conveying piston is moved further into the press cylinder in the conveying direction (10*a*) until the conveying piston has reached a predetermined target position relative to the press plate (2).

11. The method according to claim 10, characterised in that steps a) to c) are repeated several times in succession until the pressing plate (2) has reached the bottom of the barrel (50).

12. The method according to claim 10, characterised in that the starting position or the target position of the conveying piston (24) are adjustable.

13. The method according to claim 10, characterised in that the pressure in the material (52) is measured on the front side (2*a*) of the pressing plate (2) or on the front side of the conveying piston or in the conveyer line (4) close to the consumer; and the pressure is sensed by a pressure sensor and is reported to a controller and, depending thereon, the press plate drive (5) or the conveying piston drive (5') is controlled by a controller, taking into account the time delay of the pressure progress along the conveyer line (4).

14. The method of claim 10, characterised in that before and during placing the press plate (2) on the upper side of the material (52) in the barrel (50), the space between is pressurised with negative pressure, in that the barrel (50) open on one side is completely or at least with its open side introduced into an enclosure (6), the enclosure (6) is tightly closed and then the internal space (9) of the enclosure (6) is pressurised with negative pressure.

* * * * *